US007059303B2

(12) United States Patent
Magel et al.

(10) Patent No.: US 7,059,303 B2
(45) Date of Patent: Jun. 13, 2006

(54) FUEL INJECTIONY SYSTEM WITH PRESSURE BOOSTER, AND PRESSURE BOOSTER

(75) Inventors: Christoph Magel, Pfullingen (DE); Volkmar Kern, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 226 days.

(21) Appl. No.: 10/478,006

(22) PCT Filed: Apr. 27, 2002

(86) PCT No.: PCT/DE02/01552

§ 371 (c)(1),
(2), (4) Date: Nov. 17, 2003

(87) PCT Pub. No.: WO02/092998

PCT Pub. Date: Nov. 21, 2002

(65) Prior Publication Data

US 2004/0149265 A1 Aug. 5, 2004

(30) Foreign Application Priority Data

May 17, 2001 (DE) ..... 101 23 911

(51) Int. Cl.
*F02M 57/02* (2006.01)

(52) U.S. Cl. ..... 123/447; 123/456

(58) Field of Classification Search ..... 123/446, 123/447, 456, 506, 467, 496
See application file for complete search history.

(56) References Cited

U.S. PATENT DOCUMENTS

| | | | | | |
|---|---|---|---|---|---|
| 4,381,750 | A | * | 5/1983 | Funada | 123/446 |
| 4,437,443 | A | * | 3/1984 | Hofbauer | 123/446 |
| 4,459,959 | A | * | 7/1984 | Terada et al. | 123/446 |
| 4,572,136 | A | * | 2/1986 | Takeuchi et al. | 123/447 |
| 4,590,903 | A | * | 5/1986 | Hofmann et al. | 123/300 |
| 4,711,216 | A | * | 12/1987 | Takeuchi et al. | 123/447 |
| 5,622,152 | A | * | 4/1997 | Ishida | 123/446 |
| 6,422,203 | B1 | * | 7/2002 | Djordjevic | 123/456 |
| 6,637,408 | B1 | * | 10/2003 | Djordjevic | 123/456 |

FOREIGN PATENT DOCUMENTS

| | | |
|---|---|---|
| DE | 31 02 697 A1 | 10/1982 |
| DE | 199 10 970 A1 | 9/2000 |
| EP | 0 691 471 A1 | 1/1996 |

* cited by examiner

*Primary Examiner*—Thomas Moulis
(74) *Attorney, Agent, or Firm*—Ronald E. Greigg

(57) ABSTRACT

A fuel injection system for internal combustion engines, having a fuel injector that can be supplied from a high-pressure fuel source, wherein a pressure booster that is connected between the fuel injector and the high-pressure fuel source, and a pressure booster are proposed, in which a movable piston of the pressure booster divides a room that is connected to the high-pressure fuel source from a high-pressure chamber, communicating with the injector, and from a rear chamber, and the high-pressure chamber can be made to communicate with the rear chamber via a fuel line, so that the high-pressure chamber can be filled with fuel via the rear chamber.

16 Claims, 9 Drawing Sheets

FUEL INJECTIONY SYSTEM WITH PRESSURE BOOSTER, AND PRESSURE BOOSTER

CROSS-REFERENCE TO RELATED APPLICATIONS

This application is a 35 USC 371 application of PCT/DE 02/01552 filed on Apr. 27, 2002.

BACKGROUND OF THE INVENTION

1. Field of the Invention

The invention is directed to an improved fuel injection system and a pressure booster for an internal combustion engine.

2. Description of the Prior Art

German Patent Application DE 199 10 970, discloses fuel injection systems and pressure boosters in which a pressure booster, by means of filling and evacuation of a rear chamber, makes it possible to increase the fuel injection pressure beyond the value furnished by a common rail system.

German Patent Disclosure DE 31 02 697 describes a fuel injection system with a pressure booster whose rear chamber is in constant communication with a low-pressure line.

The fuel injection system and the pressure booster of the invention have the advantage over the prior art that because the high-pressure chamber of the pressure booster can be filled via the rear chamber, a separate bore serving solely to fill the high-pressure chamber need not be provided in a metal body of the pressure booster that leads the larger-diameter end of the pressure booster. Space is accordingly saved, which when the pressure booster is used in conjunction with injection system and the pressure booster defined by the independent claims are possible.

Integrating a throttle and/or a fill valve into the piston of the pressure booster is especially advantageous, so that for filling the rear chamber as well, no lines have to be led past the larger-diameter end of the piston any longer. The result is an even more-compact structure of the fuel injection system and the pressure booster.

If moreover the connecting line between the rear chamber and the high-pressure chamber and optionally also a check valve disposed in the connecting line are integrated with the piston of the pressure booster, a very slender, compact structure is obtained, which is ideal for installation in modern engines.

It also proves to be advantageous for the piston of the pressure booster to be composed of two parts of different diameters, which are movable relative to one another and thus, because of their movability relative to one another, they can perform not only the compressor function, but also the function of a valve, in particular a check valve. As a result, additional components for the provision of a separate valve assembly are eliminated, making further space-saving possible.

In further advantageous embodiments, the two-part piston takes on the function not only of a check valve but also of a fill valve, without requiring additional components for that purpose.

SUMMARY AND ADVANTAGES OF THE INVENTION

BRIEF DESCRIPTION OF THE DRAWINGS

Exemplary embodiments of the invention are described herein below, in conjunction with the drawings, in which.

DESCRIPTION OF THE PREFERRED EMBODIMENTS

Figure 1:
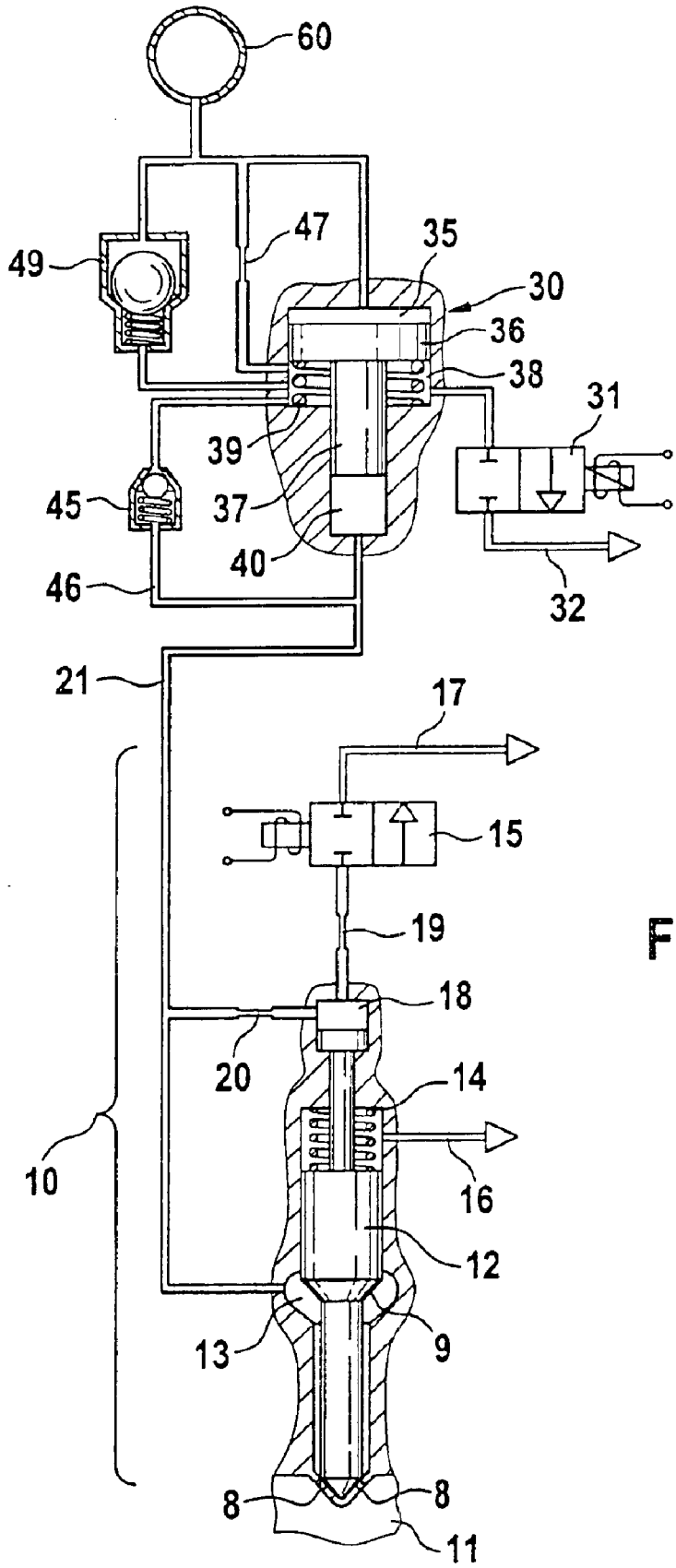
FIG. 1 shows a fuel injection system.

In FIG. 1, a fuel injection system is shown in which an injector 10 communicates via a pressure booster 30 with a high-pressure fuel source 60. The high-pressure fuel source includes a plurality of elements not shown in detail, such as a fuel tank, a pump, and a high-pressure rail of a common rail system known per se; the pump furnishes a fuel pressure that is as high as 1600 bar in the high-pressure rail, by pumping fuel from the tank into the high-pressure rail. The injector 10 has a fuel injection valve with a valve member 12, which protrudes with its injection openings 8 into the combustion chamber 11 of a cylinder of an internal combustion engine. The valve member is surrounded at a pressure shoulder 9 by a pressure chamber 13, which communicates via a high-pressure line 21 with the high-pressure chamber 40 of the pressure booster 30. The valve member shown schematically protrudes, on its end remote from the combustion chamber, into a work chamber 18, which communicates via a throttle 20 with the high-pressure line 21 and via a throttle 19 with a control valve 15 and of the injector. The control valve 15 is embodied as a 2/2-way valve and is closed in its first position; in its second position, it connects the throttle 19 with a low-pressure line 17. The valve member is resiliently supported via a restoring spring 14, and the restoring spring presses the valve member against the injection openings 8. The chamber of the injection valve of the injector that contains the spring 14 communicates with a further low-pressure line 16. The pressure booster 30 has a resiliently supported piston 36, which divides the high-pressure chamber 40, communicating with the high-pressure line 21, from a chamber 35 that is connected directly to the high-pressure fuel source 60. The spring 39 is disposed in a rear chamber 38 of the pressure booster 30. The piston 36 has an extension piece 37, which has a smaller diameter than the piston 36, on the end of the latter oriented toward the chamber 35. Via a 2/2-way valve 31, the rear chamber 38 can be made to communicate with a low-pressure line 32. Like the low-pressure lines 16 and 17, the low-pressure line 32 leads back to the fuel tank, not shown in detail. The chamber 35 of the pressure booster communicates with the rear chamber 38 via a throttle 47, and a fill valve 49 is connected parallel to the throttle 47. A fuel line 46 moreover connects the rear chamber directly to the high-pressure chamber 40 via a check valve 45.

The mode of operation of the stroke-controlled injector 10 is already known per se from German Patent Application DE 199 10 970. A high fuel pressure always prevails in the high-pressure line 21. From the pressure chamber 13, fuel flows through the injection openings 8 into the combustion chamber 11, as soon as the valve member, on its end remote from the injection openings, is relieved briefly of fuel pressure by the opening of the 2/2-way valve 15, and thus the pressure acting in the opening direction that engages the pressure shoulder 9 is greater than the total of the spring force 14 and the force resulting from the fuel pressure remaining in the work chamber 18. Conversely, in the state of repose, the valve 15 is closed, the injection valve is closed, and no injection occurs. If the booster control valve 31 is also closed, then the pressure booster 30 is in pressure equilibrium, so that no pressure boosting occurs. The fill valve 49 is then open and the piston 36, 37 is in its outset position, which is characterized by a large volume of the rear chamber 38. The pressure of the high-pressure fuel source can reach the rear chamber 38 via the open fill valve 49 and can proceed to the injector via the check valve 45. Thus at all times, an injection can take place at the pressure of the high-pressure fuel source. All that is necessary to accomplish that is for the control valve 15 of the injector to be actuated, as a result of which the injection valve opens. If an injection is then to take place at elevated pressure, the booster control valve 31 is triggered, so that the pressure in the rear chamber 38 can drop, as a result of which the fill valve 49 and the check valve 45 close. As a consequence of the pressure relief of the rear chamber 38, the piston is no longer in pressure equilibrium, and a pressure boost occurs in the high-pressure chamber 40 in accordance with the ratio of the pressure areas of the chamber 35 and the high-pressure chamber 40. Because the injection can take place at two different pressure levels (rail pressure and boosted pressure), and activation of the pressure booster is possible at any time, a flexible shaping of the course of injection can be accomplished. Square-wave, ramplike or stepped injections are possible. In a stepped course of injection, the injection begins with a first phase at low injection pressure, such as rail pressure, followed by a second phase at high injection pressure using the pressure booster. The first phase can be made arbitrarily long.

Figure 2:
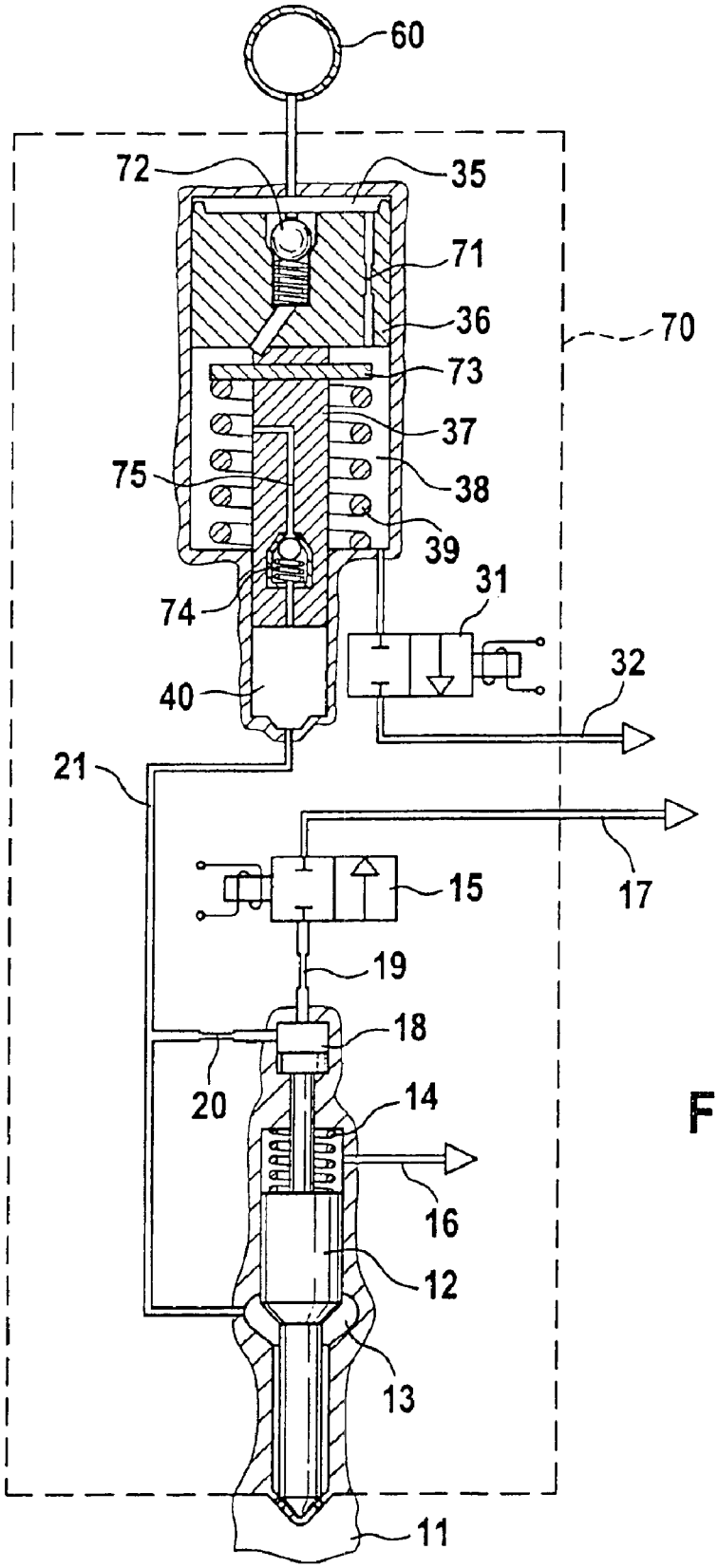
FIG. 2 shows a further fuel injection system with an integrated pressure booster.

FIG. 2 shows a fuel injection system with an injector 70 with an integrated pressure booster. The integrated version is schematically represented by a dotted line. Components identical to those of FIG. 1 are provided with the same reference numerals and will not be described again. The throttle, corresponding to the throttle 47 of FIG. 1, is embodied as an integrated throttle bore 71 in the piston; similarly, the fill valve is no longer a separate component but instead, in contrast to FIG. 1, is embodied as a fill valve 72 that is integrated with the piston. Both the throttle bore 71 and the integrated fill valve 72 are located here in the end of the piston toward the chamber 35, while the check valve 74, corresponding to the check valve 45 of FIG. 1, is integrated with the smaller-diameter extension piece 37 of the piston. The fuel line corresponding to line 46 is embodied here as an integrated fuel line 75 in the form of a bore. The spring 39, which exerts a restoring force on the piston, that is, a force for increasing the volume of the high-pressure chamber 40, is fastened between the housing of the pressure booster and a spring retainer 73 mounted solidly on the piston. The spring retainer is mounted such that a flow of fuel between the chamber 35 and the rear chamber 38 and both via the throttle 71 and via the fill valve 72 is unhindered.

The mode of operation is the same as in the embodiment shown in FIG. 1.

Optionally, only one of the components or some of the components in the group comprising the check valve, fill valve and throttle may be integrated with the piston of the pressure booster. The larger-diameter part of the piston 36 and the extension piece 37 can be embodied as two separate components. In this case as well, integration of the aforementioned components is possible.

Figure 3:
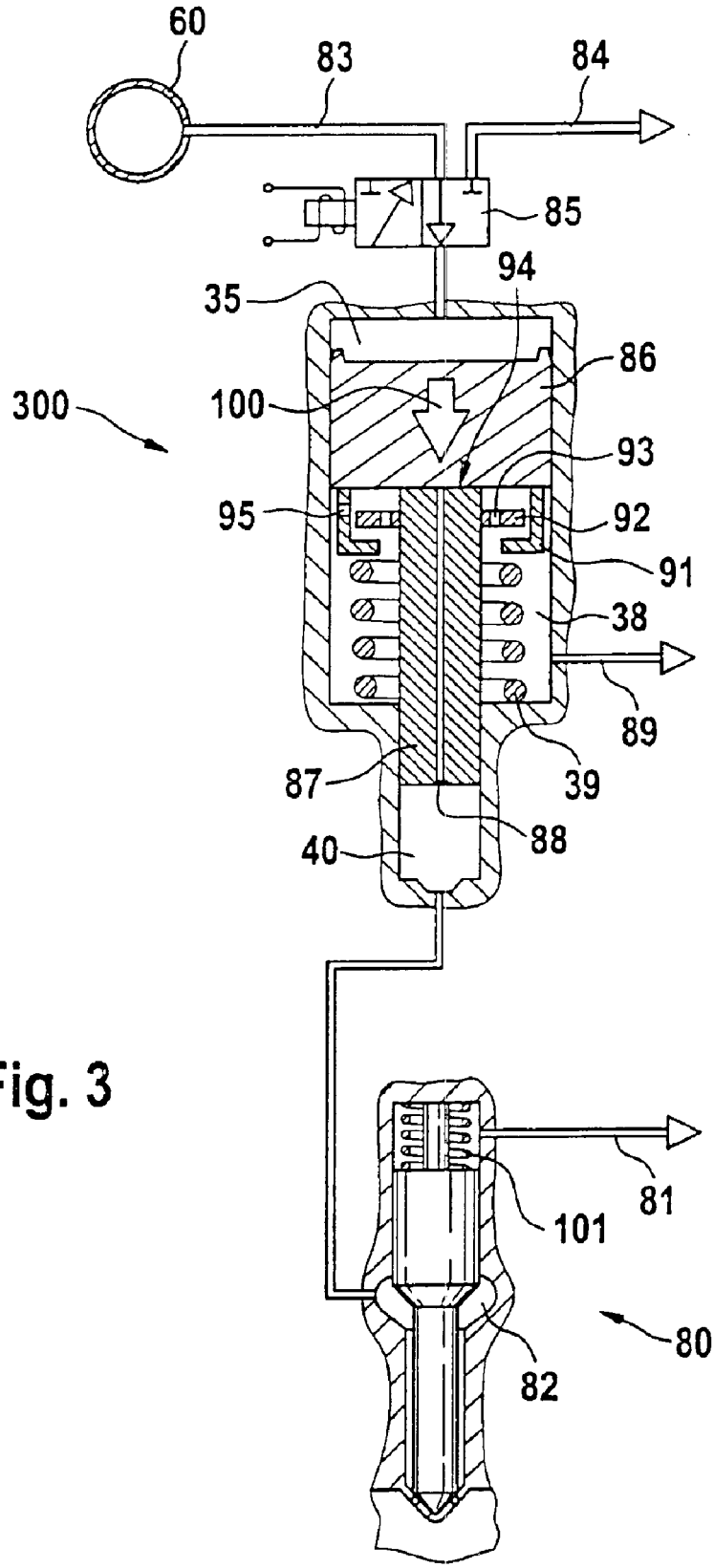
FIGS. 3 and 4 show a further exemplary embodiment in two different operating states.

FIG. 3 shows a fuel injection system of a pressure-controlled common rail system, which has one injector 80 and one pressure booster 300 for each cylinder of the engine. The pressure-controlled injector 80 has a pressure chamber 82, which for lifting its nozzle needle and for furnishing fuel to be injected can be subjected to fuel via the pressure booster 300. On the opposite end of the injector 80 from the injection opening, the spring 101, which exerts a closing force, is disposed in a chamber which in order to remove fuel leaks communicates with a leak fuel line 81 that leads to a low-pressure system, and in particular the fuel tank of the motor vehicle. The pressure chamber 82 communicates with the high-pressure chamber 40 of the pressure booster 300. The chamber 35 of the pressure booster that is located on the opposite end of the two-part piston 86, 87 can be made to communicate either with a low-pressure line 84 or with a storage line 83 via a 3/2-way valve 85. The low-pressure line 84 leads to the low-pressure system, which can direct fuel back to the fuel tank of the motor vehicle. The storage line 83 leads to a high-pressure fuel source 60, which has already been described in conjunction with FIG. 1 and which furnishes fuel at pressures of up to 2000 bar. This high-pressure fuel source has a high-pressure rail, not shown in detail, in which fuel that is at high pressure can be furnished and which can be made to communicate via a valve with each pressure booster assigned to a respective cylinder of the engine. Thus for each cylinder, one pressure booster, one metering valve 85, and one injector 80 are provided. The piston 86, 87 of the pressure booster here has one thick piston 86 and one thin piston 87; the thick piston defines the chamber 35, and the thin piston defines the high-pressure chamber 40. The thin piston 87 has a bore 88, by way of which the high-pressure chamber 40 can be made to communicate with the rear chamber 38 of the pressure booster. In the compression motion 100 of the piston shown, which is oriented downward in terms of the drawing, however, the sealing faces 94 of the thick piston and of the thin piston rest on one another and close the bore 88. A return retainer 91 mounted on the end of the thick piston 86 oriented toward the rear chamber 38 defines the freedom of motion of the thin piston 87 relative to the thick piston 86; an extension 92, which in particular is circular-annular in shape, of the thin piston is engaged by the return retainer as soon as the thick piston 86 moves some distance opposite the direction of the compression motion 100. In the extension 92, there are bores 93 for facilitating the exchange of fuel in the rear chamber in the region of the return retainer 91. For the same purpose, there is a bore 95 in the return retainer. Via the return retainer 91, the spring 39 disposed in the rear chamber 38 exerts a force that acts counter to the direction of the compression motion 100 upon the thick piston 86. The rear chamber communicates with the low-pressure system via a low-pressure line 89.

The compression motion 100 shown is activated by switching the pressure of the high-pressure fuel source, that is, the rail pressure of the common rail system, through to the chamber 35 of the pressure booster. The communication between the high-pressure chamber 40 and the low-pressure line 89 is broken, since the fuel pressure in the chamber 35 exerts a force on the thick piston 86 that is transmitted to the thin piston 87 via the sealing faces 94, so that the bore 88 is closed, and a high pressure that exceeds the fuel pressure in the high-pressure rail of the common rail system can be built up in the high-pressure chamber 40.

Figure 4:
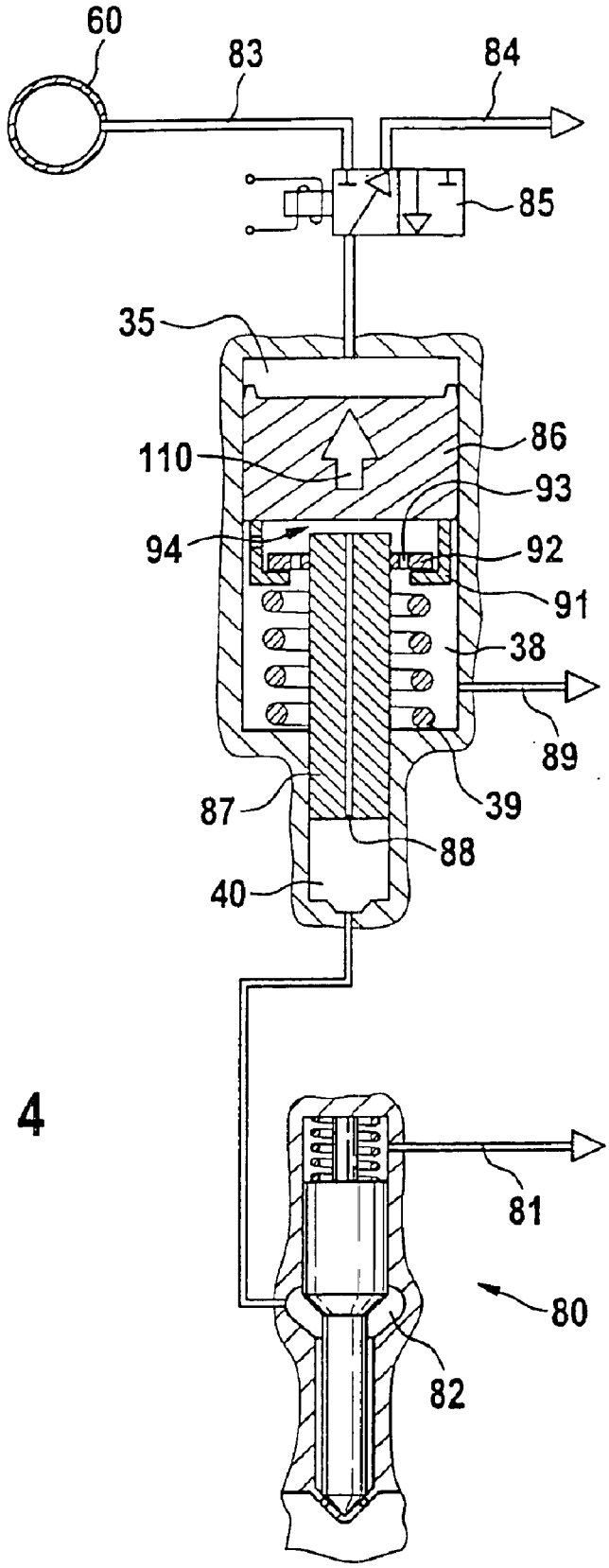

FIG. 4 shows the same system as FIG. 3, but in a different operating state, in which the two-part piston 86, 87 executes a compensatory motion 110 oriented counter to the compression motion 100.

When the injection is to be terminated, the chamber 35 is made to communicate, as shown in FIG. 4, with the low-pressure line 84 via the 3/2-way valve 85. As a result, the chamber 35 is disconnected from the rail pressure, and the two-part piston returns to its outset position. First, only the thick piston 86 moves upward, until the return retainer 91 strikes the extension 92 of the thin piston 87 and pulls the thin piston upward along with it. The sealing faces 94 now no longer rest on one another, and the high-pressure chamber 40 can be filled with new fuel via the bore 88 and the low-pressure system.

Alternatively to the situation shown, in which the sealing faces 94 are formed of the flat face ends of the thick piston and the thin piston, these sealing faces can also be provided on one side with a sealing edge surrounding the bore 88. A spherical or hollow-spherical embodiment of the sealing faces may be advantageous in order also to assure tightness in the event that an angular offset of the two pistons should occur. This way of filling the high-pressure chamber 40 can be employed not only in the application shown but in all applications in which filling of the high-pressure chamber takes place from the rear chamber of a pressure booster.

Figure 5:
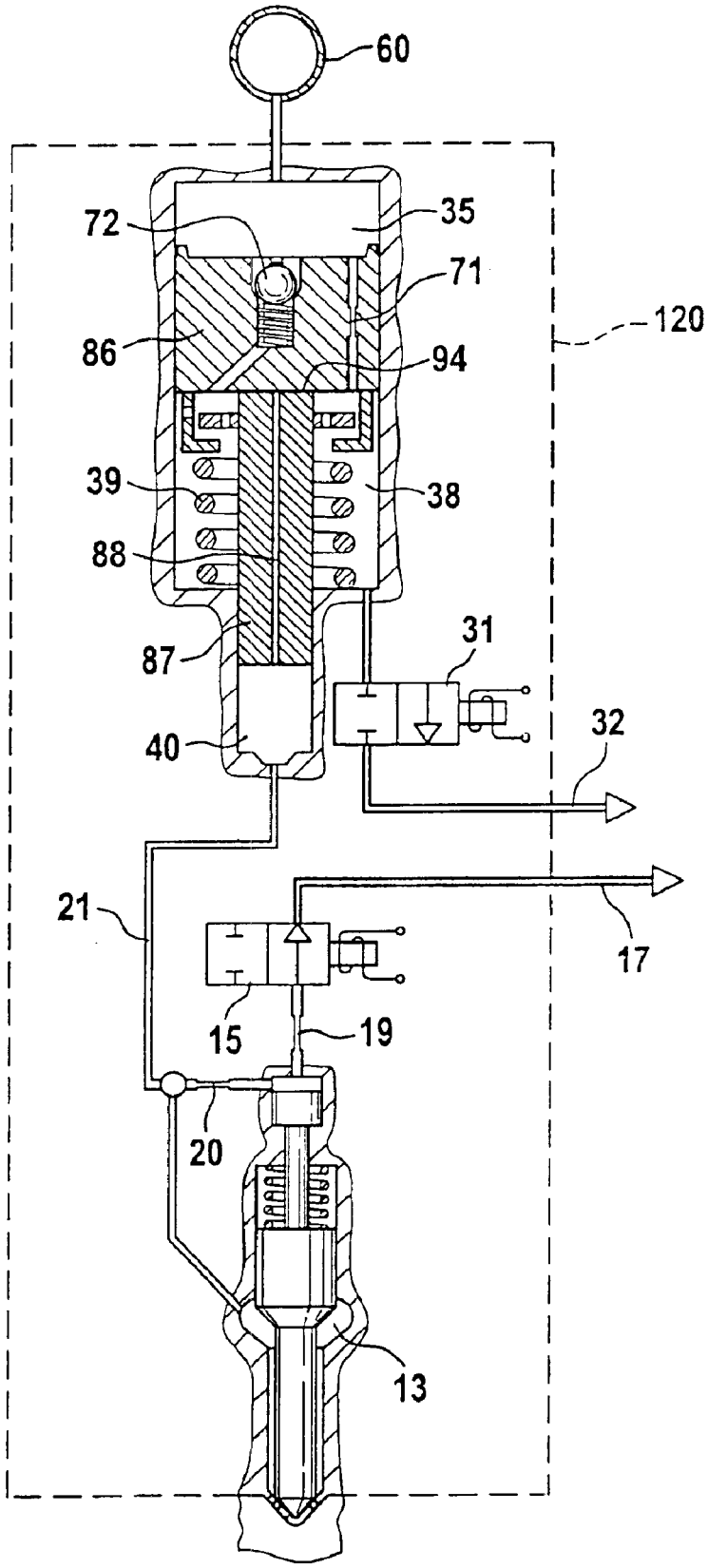
FIG. 5 shows an injector with a pressure booster, with whose two-part piston a throttle and a fill valve are integrated.

FIG. 5 shows one such further application in a stroke-controlled, pressure-boosted common rail system. Components identical or similar to those of FIG. 1 are identified by the same reference numerals and will not be described again. Essentially, in contrast to FIG. 2, instead of having a pressure booster with a one-piece piston, the injector 120 with an integrated pressure booster has a pressure booster with a two-part piston. Here, the version of the pressure booster with a two-part piston in accordance with FIGS. 3 and 4 is combined with the integration of a throttle 71 and a fill valve 72 with the larger-diameter part of the pressure booster piston 86, 87, analogously to the exemplary embodiment of FIG. 2.

In the state of repose, both the valve 31 and the valve 15 are closed. The nozzle is closed, and no injection takes place. Since rail pressure now also prevails in the rear chamber 38, the pressure booster piston is pressure-balanced, so that no pressure boosting occurs. The sealing faces 94 are not pressed against one another, and so the bore 88 is uncovered for filling the high-pressure chamber 40, and the two-part piston of the pressure booster is restored to its outset position. Moreover, via the fill valve 72 and the bore 88, the rail pressure reaches the high-pressure chamber 40 and the pressure chamber 13 of the injector. Thus an injection at rail pressure can occur at all times. To that end, the control valve 15 of the injector is actuated, causing the nozzle to open, as shown in FIG. 5. If an injection at elevated pressure is now to occur, the control valve 31 must be triggered, or in other words opened. As a result, the pressure in the rear chamber 38 drops, so that the thick piston 86 is pressed against the thin piston 87, and the sealing faces 94 are pressed together. The bore 88 is closed as a result and performs the function of a check valve: The fuel located in the high-pressure chamber 40 can no longer flow back into the rear chamber 38. Moreover, the fill valve 72 is closed. Because of the pressure relief of the rear chamber 38, the two-part piston 86, 87 is accordingly no longer pressure-balanced, and a pressure boost occurs in the high-pressure chamber 40 in accordance with the ratio of pressure areas of the chamber 38 and chamber 40. If the pressure booster is switched off by a closure of the valve 31, then via the throttle 71, a pressure equilibrium is effected among the chambers 35, 38 and 40. If the fuel pressure in the rear chamber 38 nearly reaches the pressure in the chamber 35, the fill valve 72 opens and opens the communication from chamber 35 to chamber 38. Moreover, by means of the restoring spring 39, the pistons 86 and 87 are disconnected from one another. Rapid filling of the rear chamber and hence a fast restoration of the two-part pressure booster piston can thus be brought about. The filling of the high-pressure chamber now takes place via the bore 88.

Figure 6:
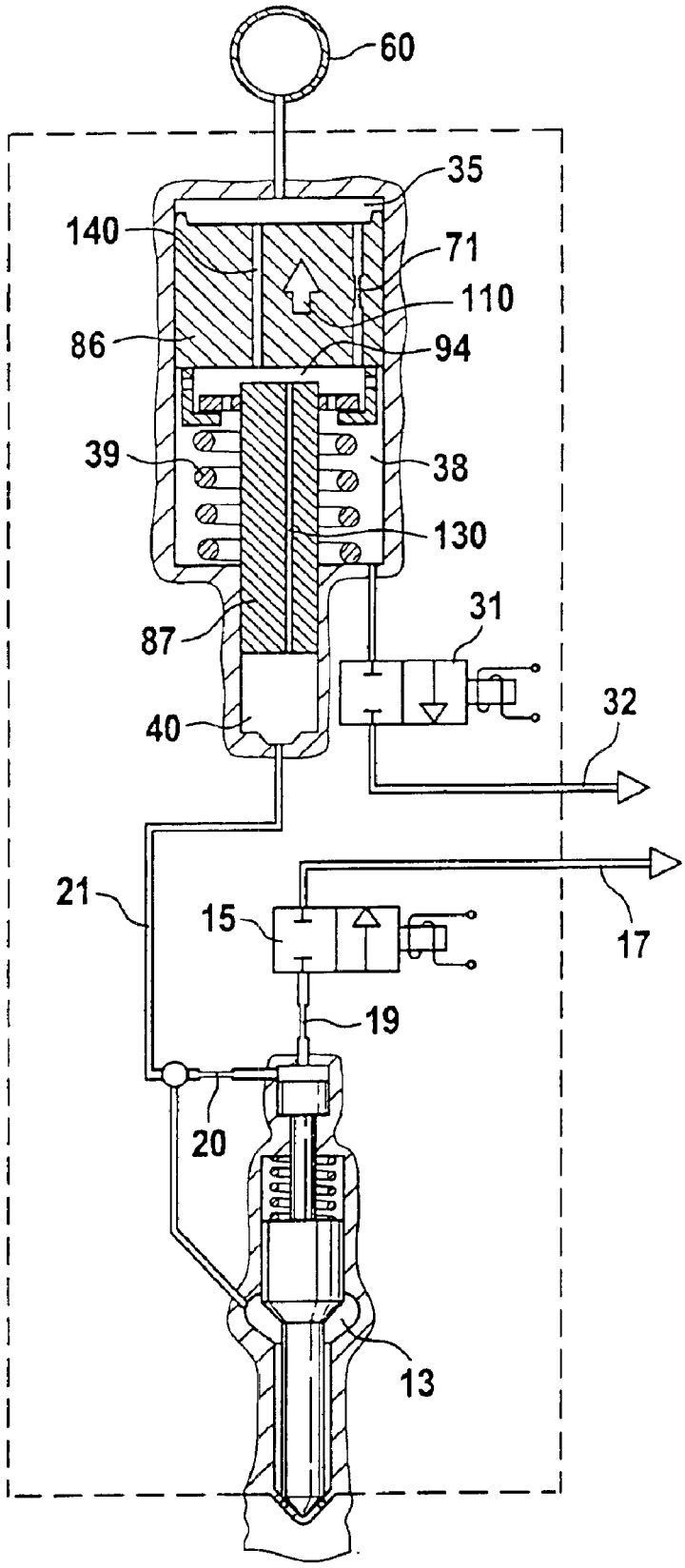
FIG. 6 shows a further exemplary embodiment with an alternative embodiment of the fill valve.

FIG. 6 shows a further embodiment of a pressure-boosted common rail system. Components the same as or similar to those of FIG. 5 are identified by the same reference numerals and will not be described again. In a distinction from the embodiment of FIG. 5, instead of the central bore 88 in the thin piston 87, a bore 130 that is laterally offset slightly is provided, to make it possible to replace the fill valve 72 with a simpler embodiment, in the form of a through bore 140 in the thick piston 86.

Precisely whenever the rear chamber is pressure-relieved, the flat sealing faces 94 of the thin piston and the thick piston rest on one another, and not only the bore 130 but also the bore 140 are closed. Thus the bore 140 can perform precisely the same function as the fill valve 72 of FIG. 5, which is realized in the form of an integrated spring-loaded ball.

Alternatively to the embodiment of the sealing faces by the flat piston ends, it is possible, as already described above, to employ other geometries, such as a spherical or hollow-spherical surface form, particularly in the region around the bores. The filling path 140 can also be replaced by or supplemented with a plurality of bores. A sealing edge surrounding all the bores 140 and 130 can likewise be provided on at least one end of the two pistons.

Figure 7:
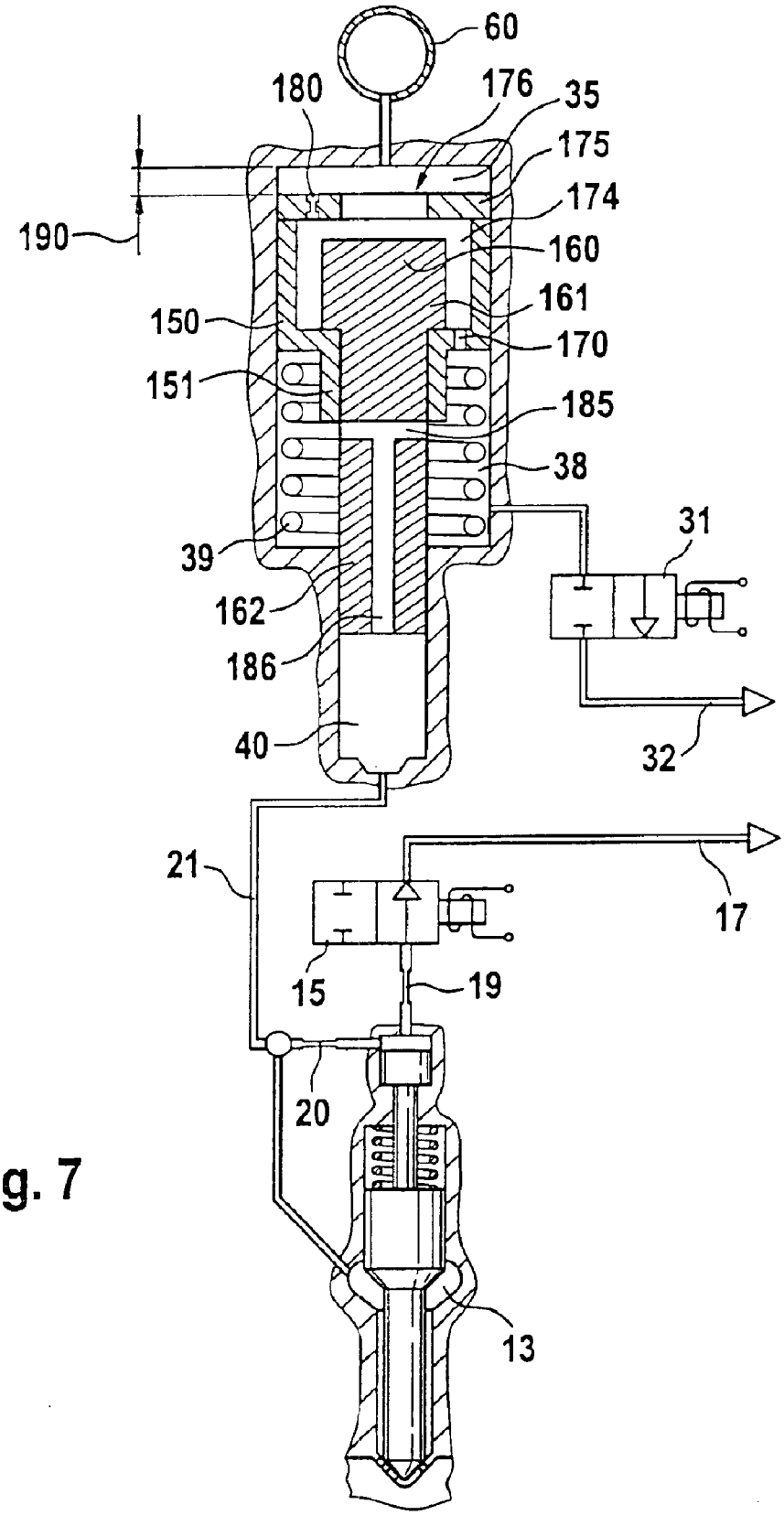
FIGS. 7, 8 and 9 illustrate alternative versions of a two-part piston.

FIG. 7 shows a further embodiment of a pressure-boosted common rail system. Components identical or similar to those of FIG. 6 are identified by the same reference numerals and will not be described again. Unlike the embodiment of Fig. 6, here the two-part piston is constructed not of two partial pistons 86 and 87 in line with one another but instead of two pistons 150 and 160 that engage one another on the inside. The drawing is a cross-sectional side view and shows the valve chamber 174, formed by the void in the thick piston 150, into which valve chamber the thin piston 160 protrudes with its piston region 161. The piston region 161 changes over into a smaller-diameter neck region 162 of the thin piston 160 that is guided in fluidproof fashion by a guide region 151 of the thick piston 150. The restoring spring 39 is fastened between the housing of the pressure booster and the region of the thick piston 150 that is larger in diameter than the guide region 151. On the side of the chamber 35, the thick piston 150 is partly closed by a circular-annular plate 175, which is solidly connected to the thick piston. The circular-annular plate has a centrally disposed passage region 176, which can be closed by means of a motion of the thin piston relative to the thick piston. Moreover, a throttle bore 180 is located in a peripheral region of the plate 175 and remains uncovered as a consequence of a spacing apart of the piston region 161 from the thick piston 150, regardless of the position of the thin piston relative to the thick piston. A longitudinal bore 186 that discharges into the high-pressure chamber 40 is located in the neck region 162 of the thin piston 160. The longitudinal bore changes over, on its end remote from the high-pressure chamber 40, into a transverse bore 185 that discharges on both ends into the rear chamber 38 of the pressure booster. The freedom of motion of the thin piston relative to the thick piston is limited on one side by a striking against the plate 175 of the side on the piston region 161 toward the chamber 35, and on the other side is limited by a seating of the piston region on the transitional region of the thick piston, between the guide region 151 and the larger-diameter remainder of the thick piston, and travels along a free stroke distance 190. If the thin piston is moving in the direction of the chamber 35, then the thick piston first closes the transverse bore 185, and after traversing the free stroke distance, the passage region 176 is closed by the thin piston. In this transition region, a bore 170 is also provided, which connects the valve chamber 174 with the rear chamber 38.

The check valve 45, 74, and 94 from the exemplary embodiments of FIGS. 1, 2 and 3, respectively, is formed in the embodiment of FIG. 7 by the guide region 151 and by the transverse bore 185, which is closable by the guide region. The function of the throttle 47 and 71 from the exemplary embodiments of FIGS. 1 and 2, respectively, is taken over by the throttle bore 180 and the bore 170. The function of the fill valve 49, 72 and 140 from the exemplary embodiments of FIGS. 1, 2, 5 and 6, respectively, is assured here by the piston region 161, the passage region 176 that is closable by the piston region, and the bore 170. The system is shown in the state of repose, with the pressure booster deactivated. The rail pressure prevails in the chamber 35, in the valve chamber 174 via the passage region 176, in the rear chamber 38 via the bore 170, and in the high-pressure chamber 40 via the longitudinal bore 186. The pressure booster is pressure-balanced, and the thick piston 150 is kept in its upper position via the restoring spring 39. The bores 185 and 186 form a bypass path, which makes a preinjection at rail pressure or a bootlike main injection possible. These bores are opened only in the phase in which the pressure booster is not triggered, or in the phase in which the pressure booster is moving in reverse.

Figure 8:
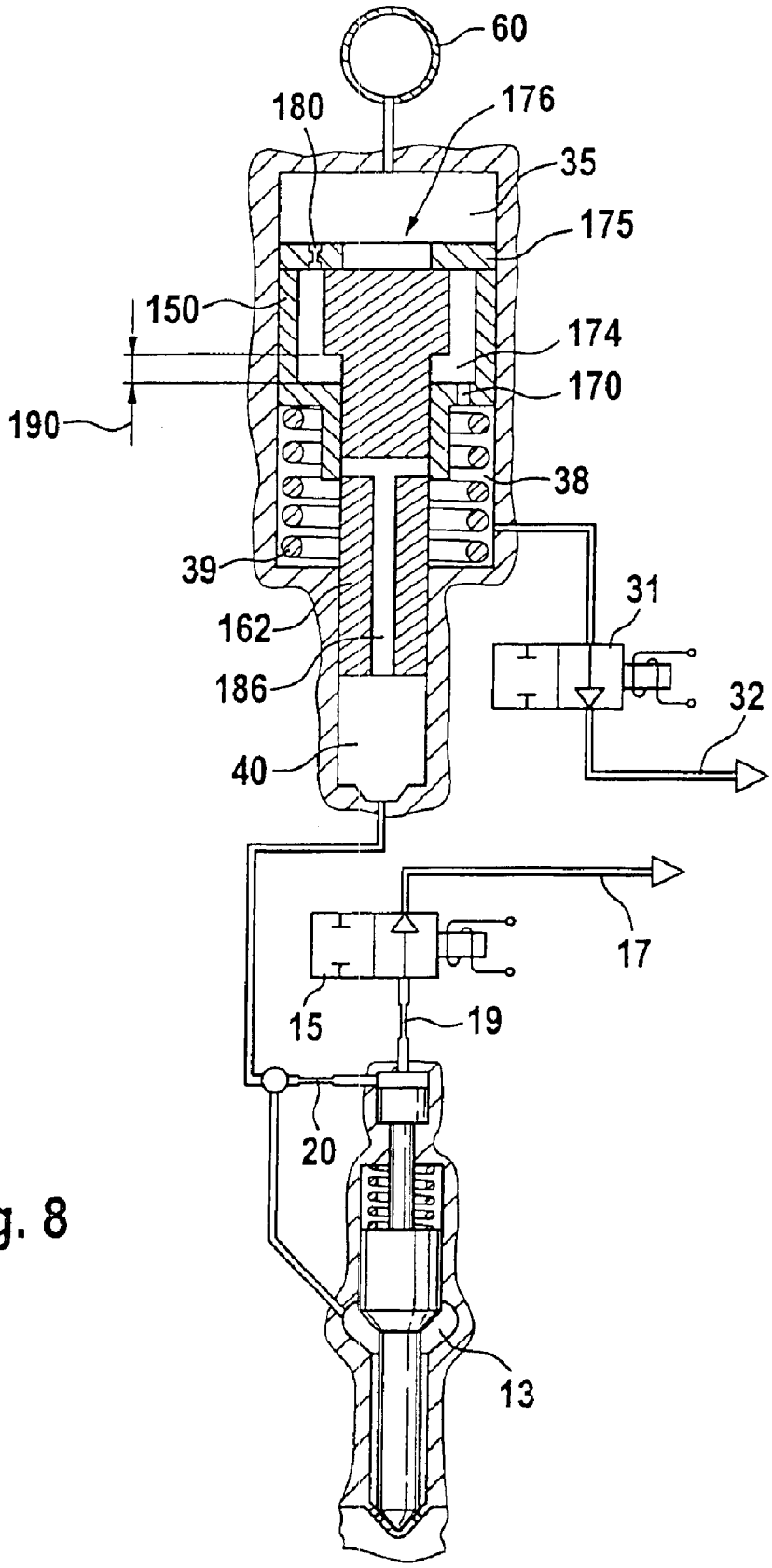

FIG. 8 shows the system of FIG. 7 during the pressure boosting. To that end, the 2/2-way valve 31 is triggered to relieve the rear chamber 38. As a result, the piston 150 is no longer pressure-balanced, since rail pressure still prevails in the chambers 35 and 174 but no longer prevails in the rear chamber 38 which is at the leak fuel pressure level. The piston 150 moves forward some distance, which is the free stroke distance 190, relative to the thin piston 160 and closes the transverse bore 185. The thin piston 160 is guided both by the guide region 151 of the thick piston 150 and, on its end oriented toward the high-pressure chamber 40, by the housing of the pressure booster. Once the bypass path has closed and the free stroke distance has been traversed, the thick piston 150 carries the thin piston 160 along with it, since the passage region 176 is not large enough for the piston region 161 to move through it. The piston region 161 and the plate 175 now furthermore seal the valve chamber 174 off from the chamber 35. As a result of the joint downward motion of the thin and thick pistons, the fuel in the high-pressure chamber 40 is now compressed in accordance with the ratio of pressure areas of the chambers 35 and 40. If the pressure boosting is to be terminated, then the valve 31 is closed again. The chamber 38 is then no longer in communication with the low-pressure system, and the pressure in the valve chamber 174 can rise again to rail pressure via the throttle bore 180. In the rear chamber 38 as well, the fuel pressure returns to rail pressure via the throttle bore 180, the valve chamber 174, and the bore 170. As a result, the piston 150 is once again pressure-balanced and is pressed upward via the restoring spring 39. Once it has covered the free stroke distance 190, the thick piston again carries the thin piston along with it to its outset position, via the shoulder of the thin piston that is formed by the transition between the neck and head regions. The bore 185, once the free stroke has been traversed, is opened again, so that it connects the high-pressure chamber with the rear chamber. The high-pressure chamber can thus be filled with fuel via the rear chamber, and both pistons 150 and 160 return completely to their outset position. In the construction shown in FIGS. 7 and 8, it is assured that upon triggering of the pressure booster, the piston 150 overtakes the transverse bore 185, and the inlet from the chamber 35 to the valve chamber is closed. To that end, the bore 170 is designed such that the pressure equilibrium between the valve chamber and the rear chamber proceeds slowly; that is, for some length of time the piston 150 is not pressure-balanced and exceeds the force of the restoring spring 39. This means that the bore 170 must perform throttling until such time as the inlet from the chamber 35 to the valve chamber 174, and thus via the bore 170 to the rear chamber 38, is closed, and both chambers can be relieved via the leak fuel line and the valve 31. The high-pressure chamber 40 moreover is not relieved in the initial phase of the motion of the piston 150, since otherwise it would no longer be possible to achieve a high injection pressure. That is assured by the provision that the transverse bore 185 is small relative to the total stroke that the pressure booster can traverse, so the pressure booster can overtake the transverse bore quickly. Advantageously, they also have a throttling action and in the phase of the overtaking do not allow any significant pressure reduction in the high-pressure chamber.

For improved sealing of the passage region 176 by the piston region 161 of the thin piston 160, an O-ring may be provided, which is mounted on the plate or on the piston region. This O-ring makes it possible to compensate for imprecisions in production and installation.

Figure 9:
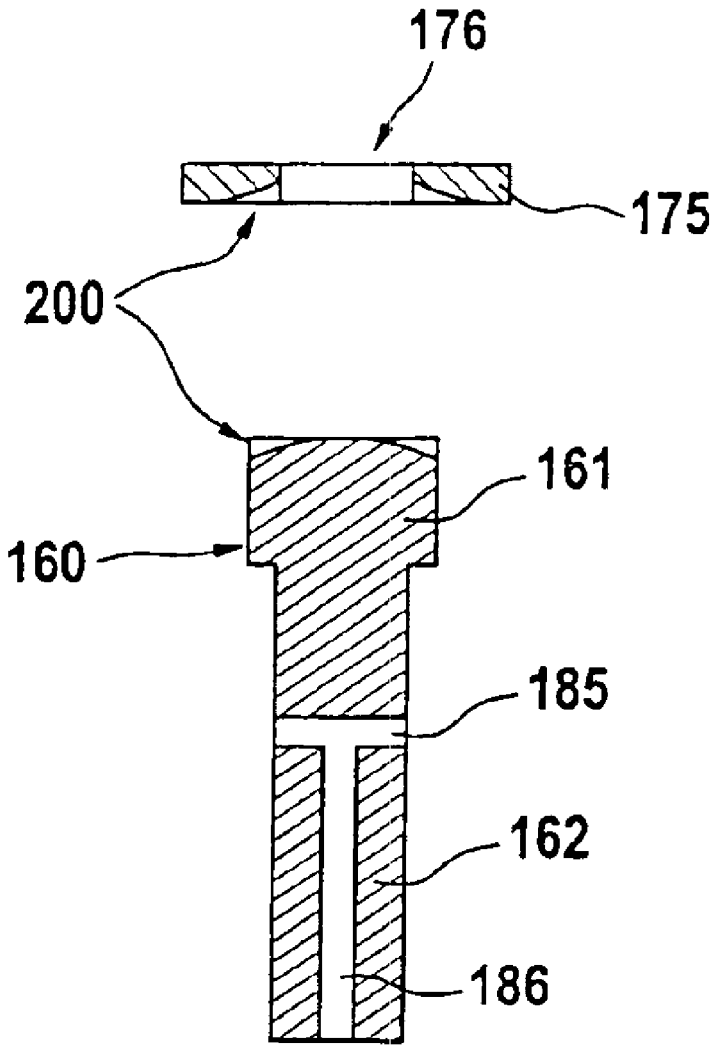

FIG. 9 shows the details of a further variant embodiment of the pressure booster illustrated in FIGS. 7 and 8. In FIGS. 7 and 8, the throttle is embodied as a bore in the plate 175, while in the alternative form, the plate 175, at at least one point on the circumference of the passage region 176, has a fluted chamfer or groove 200, which itself assures a throttled flow through of fuel upon seating of the plate on the piston region of the thin piston. In this way as well, a pressure equilibrium between the chambers 35, 174 and 38 can be provided for once a pressure buildup has occurred yet the pressure booster has been deactivated again via the valve 31. As an alternative to or in combination with grooves in the plate, grooves 200 may also be provided in the piston region 161 of the thin piston 160.

The foregoing relates to preferred exemplary embodiments of the invention, it being understood that other variants and embodiments thereof are possible within the spirit and scope of the invention, the latter being defined by the appended claims.

What is claimed is:

1. A fuel injection system for internal combustion engines, comprising a fuel injector (10) that can be supplied from a high-pressure fuel source (60), a pressure booster (30) having a movable piston (36), the pressure booster being connected between the fuel injector and the high-pressure fuel source and the movable piston separating a chamber (35) that is connected to the high-pressure fuel source (60), from a high-pressure chamber (40) communicating with the injector (10) and from a rear chamber (38), a fuel line (46; 75; 88; 186) connecting the high-pressure chamber (40) in communication with the rear chamber (38) in such a way that the high-pressure chamber can be filled via the rear chamber with the high pressure of the high-pressure fuel source (60);

a fill valve (49; 72; 140; 161, 170, 176), the chamber (35) communicating with the rear chamber (38) via the fill valve, and control valve means (31) connecting the rear chamber (38) for communication with a low-pressure line (32), whereby by filling the rear chamber with fuel and by evacuating the rear chamber of fuel, the fuel pressure in the high-pressure chamber can be varied.

2. The fuel injection system of claim 1, further comprising a valve, in particular a check valve (45; 74; 94; 151, 185) disposed in the fuel line (46; 75; 88; 186), whereby a reverse flow of fuel from the high-pressure chamber into the rear chamber can be prevented.

3. A fuel injection system for internal combustion engines, comprising a fuel injector (10) that can be supplied from a high-pressure fuel source (60), a pressure booster (30) having a movable piston (36), the pressure booster being connected between the fuel injector and the high-pressure fuel source and the movable piston separating a chamber (35) that is connected to the high-pressure fuel source (60) from a high-pressure chamber (40), communicating with the injector (10), and from a rear chamber (38), a fuel line (46; 75; 88; 186) connecting the high-pressure chamber (40) in communication with the rear chamber (38) in such a way that the high-pressure chamber can be filled via the rear chamber with the high pressure of the high-pressure fuel source (60);

the fuel line (46; 75; 88; 186) and the valve (45; 74; 94; 151; 185) being integrated with the piston (36, 37, 86, 87, 150, 160) and control valve means (31) connecting the rear chamber (38) for communication with a low-pressure line (32), whereby by filling the rear chamber with fuel and by evacuating the rear chamber of fuel, the fuel pressure in the high-pressure chamber can be varied.

4. A fuel injection system for internal combustion engines, comprising a fuel injector (10) that can be supplied from a high-pressure fuel source (60), a pressure booster (30) having a movable piston (36) including two parts movable relative to one another, the pressure booster being connected between the fuel injector and the high-pressure fuel source and the movable piston separating a chamber (35) that is connected to the high-pressure fuel source (60) from a high-pressure chamber (40), communicating with the injector (10), and from a rear chamber (38), a fuel line (46; 75; 88; 186) connecting the high-pressure chamber (40) in communication with the rear chamber (38) in such a way that the high-pressure chamber can be filled via the rear chamber with the high pressure of the high-pressure fuel source (60); and control valve means (31) connecting the rear chamber (38) for communication with a low-pressure line (32), whereby by filling the rear chamber with fuel and by evacuating the rear chamber of fuel, the fuel pressure in the high-pressure chamber can be varied.

5. The fuel injection system of claim 2, wherein the piston comprises two parts (86, 87; 150, 160) that are movable relative to one another.

6. The fuel injection system of claim 3, wherein the piston comprises two parts (86, 87; 150, 160) that are movable relative to one another.

7. The fuel injection system of claim 4, wherein the two piston parts comprise one thin piston (87; 160) and one thick piston (86; 150).

8. The fuel injection system of claim 7, wherein the fuel line is integrated with the thin piston (87; 160) in the form of a bore (88; 186).

9. The fuel injection system of claim 2, wherein the piston (36) comprises two parts including a thin piston part (87; 101) and a thick piston part (86;150), and wherein the fuel line is integrated with the thin piston (87; 160) in the form of a bore (88; 186), and wherein the thin piston part (87) and the thick piston (86) communicate with one another via connecting means (91, 92) in such a way that sealing faces (94), facing one another, of the two pistons close the bore (86) in the event that the thick piston is resting on the thin piston.

10. The fuel injection system of claim 1, wherein the piston (36) comprises two parts including a thin piston part (87; 160) and a thick piston part (86; 150), and where the fuel line is integrated with the thin piston (87; 160) in the form of a bore (88; 186), and wherein the thin piston (160) comprises a piston region (161) protruding into a valve chamber (174) formed by a void in the thick piston (150), and a smaller-diameter neck region (162) of the thin piston (160) that adjoins the piston region can move within a guide (151) that seals off the void, so that the bore (186) can be closed on one end by the guide region.

11. The fuel injection system claim of claim 1, further comprising a throttle (47; 71; 180, 170) providing communication between the chamber (35) with the rear chamber (38).

12. The fuel injection system claim 11, wherein the throttle (71, 180, 170) is integrated with the piston (36, 37; 86, 87; 150, 160).

13. The fuel injection system claim 1, wherein the fill valve (72; 140; 161, 176, 170) is integrated with the piston (36, 37; 86, 87; 150, 160).

14. The fuel injection system claim 13, wherein the fill valve comprises at least one through bore (140; 170) in the thick piston (86; 150).

15. In a pressure booster comprising a movable piston (36) separating a chamber (35) that can be connected to a high-pressure fuel source from a high-pressure chamber (40) that can be made to communicate with a fuel injector (10) and from a rear chamber (38), the improvement comprising a valve, in particular a check valve (45; 74; 94; 151, 185) disposed in the fuel line (46; 75; 88; 186), whereby a reverse flow of fuel from the high-pressure chamber into the rear chamber can be prevented, wherein the fuel line (46; 75; 88; 186) and the valve (45; 74; 94; 151, 185) are integrated with the piston (36, 37; 86, 87; 150, 160), and wherein the high-pressure chamber (40) can be made to communicate with the rear chamber (38) via a fuel line (46; 75; 88; 186).

16. The pressure booster of claim 4, further comprising a check valve (45, 74; 94; 151; 185) disposed in the fuel line (46; 75; 88; 186), so that a reverse flow of fuel from the high-pressure chamber into the rear chamber can be prevented.

* * * * *

UNITED STATES PATENT AND TRADEMARK OFFICE

CERTIFICATE OF CORRECTION

PATENT NO. : 7,059,303 B2
APPLICATION NO. : 10/478006
DATED : June 13, 2006
INVENTOR(S) : Christoph Magel et al.

It is certified that error appears in the above-identified patent and that said Letters Patent is hereby corrected as shown below:

Title page,

Item (54) and column 1, line 1 should read as follows:

(54) FUEL INJECTION SYSTEM WITH PRESSURE BOOSTER, AND PRESSURE BOOSTER

Signed and Sealed this

Fifteenth Day of August, 2006

JON W. DUDAS
*Director of the United States Patent and Trademark Office*